US007098581B2

(12) United States Patent
Cleeves

(10) Patent No.: US 7,098,581 B2
(45) Date of Patent: Aug. 29, 2006

(54) SPARK PLUG

(76) Inventor: James M. Cleeves, 551 Summit Dr., Redwood City, CA (US) 94062

( * ) Notice: Subject to any disclaimer, the term of this patent is extended or adjusted under 35 U.S.C. 154(b) by 84 days.

(21) Appl. No.: 10/663,162

(22) Filed: Sep. 15, 2003

(65) Prior Publication Data

US 2005/0057132 A1 Mar. 17, 2005

(51) Int. Cl.
*H01T 13/46* (2006.01)

(52) U.S. Cl. ..... 313/123; 313/141

(58) Field of Classification Search ..... 313/123, 313/124, 139–142; 123/169 MG, 169 CB, 123/169 R, 169 EL, 169 G; 315/58, 59
See application file for complete search history.

(56) References Cited

U.S. PATENT DOCUMENTS 1,525,707 A * 2/1925 Wetzel ..... 313/122
3,394,285 A * 7/1968 Lindsay ..... 315/58
3,488,556 A 1/1970 Burley
3,567,987 A 3/1971 Schnumacher
3,719,851 A 3/1973 Burley
3,908,145 A 9/1975 Kubo
3,956,664 A * 5/1976 Rado et al. ..... 315/58
4,004,562 A * 1/1977 Rado et al. ..... 123/169 MG
4,535,735 A 8/1985 Yoshinaga et al.
5,821,675 A * 10/1998 Suzuki ..... 313/123
6,089,201 A * 7/2000 Hubbard ..... 123/179.21
6,194,819 B1 * 2/2001 Codina et al. ..... 313/141
6,603,245 B1 * 8/2003 Fletcher ..... 313/141

* cited by examiner

*Primary Examiner*—Ashok Patel
*Assistant Examiner*—Christopher M. Raabe
(74) *Attorney, Agent, or Firm*—Blakely, Sokoloff, Taylor & Zafman LLP

(57) ABSTRACT

A spark plug is disclosed having at least one main electrode and at least one secondary electrode. The gaps associated with the secondary electrodes are between one third and two thirds the optimum gap distance. Resistors associated with the secondary electrodes control the current flow and therefore the voltage on the electrodes.

11 Claims, 6 Drawing Sheets

SPARK PLUG

FIELD OF THE INVENTION

The invention relates to the field of spark plugs for internal combustion engines.

BACKGROUND OF THE INVENTION

Spark plugs having multiple air gaps and employing resistors are known such as described in U.S. Pat. No. 4,004,562. In general, the air gaps are substantially equal in length and equal to the maximum or optimum gap for the engine. In operation, once current flows in a gap most of the voltage drop is across the resistor and only a small voltage drop occurs across the gap. Each gap receives the full voltage employed by the ignition system until current flows. Thus, the length of the gaps are made to be substantially the same and equal to the length of the gap of a single gap spark plug operating under the same conditions.

In U.S. Pat. No. 3,488,556, a teaser gap is employed to ionize some of the gases in the main gap, and consequently, to reduce the voltage required to initiate sparking in the main gap. This teaser or secondary gap is not intended to ignite the gases in the cylinder, although under heavy load conditions, it may do so.

As will be seen, the present invention provides novel variations of a multiple gap spark plug.

SUMMARY OF THE INVENTION

A spark is disclosed, in one embodiment, having a first and a second main electrode spaced-apart by a distance N. A plurality of secondary electrodes are disposed between the main electrodes, each having a gap between one another and the main electrodes. The sum of the gap distances associated with the secondary electrodes is equal to N. Each of the gaps can be different from one another. A resistor couples each of the secondary electrodes to one of the main electrodes.

In one embodiment, the gaps are each one-third to two-thirds of an optimal gap distance.

DETAILED DESCRIPTION

Figure 1:
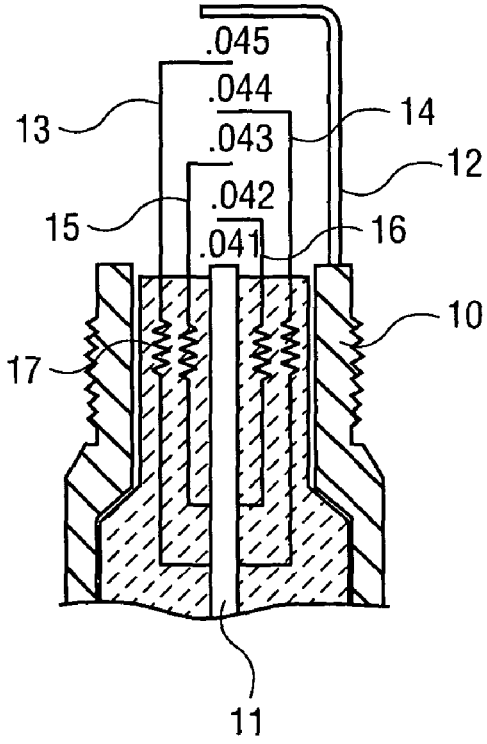
FIG. 1 is cross-sectional elevation view of a portion of a spark plug illustrating mainland secondary electrodes.
Figure 2:
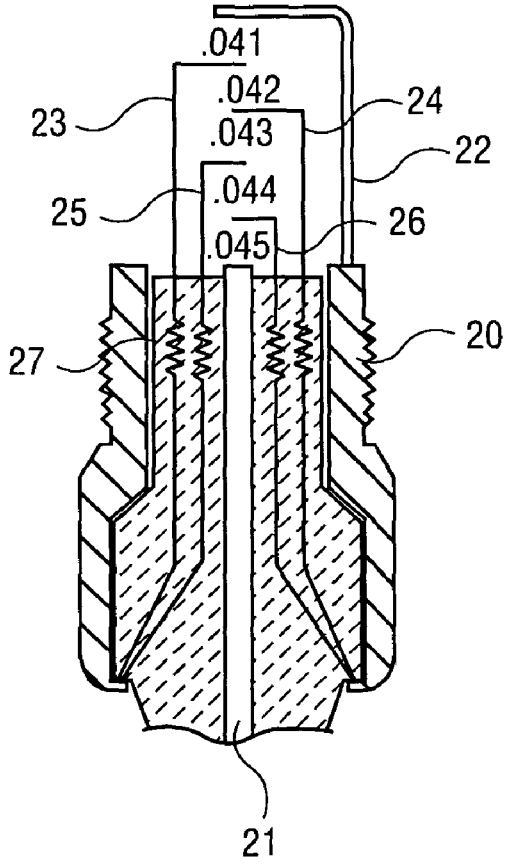
FIG. 2 illustrates another embodiment of the spark plug shown in FIG. 1.

Several embodiments of a spark plug having multiple gaps is described. In the following description, numerous specific details are set forth, such as specific gaps distances, in order to provide a thorough understanding of the present invention. It will be apparent to one skilled in the art that the present invention may be practiced without these specific details. In other instances, details which are known in the art, such as those associated with the fabrication of a spark plug, are not set forth here in order not to unnecessarily obscure the present invention.

In a typical prior art spark plug having a single gap, the gap is typically optimized. The optimum gap is generally as large as possible in order that the flame kernel be as large as possible. The optimum gap needs to provide ignition under the worst operating conditions including voltage for the spark plug, and consequently, the gap is selected to operate over a range of engine pressures, mixtures and other operating conditions.

As will be seen with the various embodiments described below, the gaps used in association with the secondary electrodes range between one-third and two-thirds of the optimum gap, and moreover the current and voltage are controlled with the secondary electrodes as will be described.

The effective resistance of the gap between two electrodes varies substantially depending on the environment. Prior to ionization the resistance is >10 billion ohms. There is a pre-ionization region where the effective resistance can be millions of ohms and as low as a few tens of ohms in an arc discharge. Additionally, the resistance of the gap typically becomes lower for most of these conditions as the pressure is increased, as it would be in the combustion chamber of an internal combustion engine.

The function of the resistors in series with the electrodes in this invention is to have each end of the resistor be at close to the same voltage when the gap resistance is high, but then to drop most of the supply voltage across the resistor once the gap ionizes and the gap resistance goes very low. As an example, if the high voltage supplied to the spark plug electrode is 10,000 volts and the resistor value was 10,000,000 ohms, prior to ionization the gap resistance might be 1,000,000,000 ohms. At those conditions the current flow would be 0.00001 amps and the voltage at the downstream end of the resistor would be 9,990 volts. But once the gap ionizes, the resistance of the gap drops significantly. If the gap resistance drops to 100,000 ohms, then the total current increases to almost 0.001 amps. At that current, the voltage drop across the resistor increases to approximately 9,900 volts so that the downstream end of the resistor is approximately 100 volts above the electrode on the other side of the gap. Once the downstream end of the resistor has dropped in voltage, the electrode attached to it is at low voltage compared to a similar electrode nearby. So the same breakdown would take place between the second resistor electrode and the first. However, the first electrode is now at 100 volts above the first so only 9,900 volts of the original 10,000 would be available to ionize the second gap. In this way the spacing between subsequent electrodes in this series should be closer to each other than prior pairs. Alternately, all gaps could be equal, but they would need to be at the size necessary to reliably spark the last gap. The discussion in this paragraph applies to the embodiment of FIGS. 1–3, 5 and 6.

A second embodiment (FIGS. 7 and 8) uses the ions generated between a pair of these high value resistor electrodes to provide a source of conductors that reduces the breakdown voltage between another pair of electrodes. Both of the electrodes of the resistor pair need to be connected to high value resistors so that when the breakdown starts from one of the second electrodes the first electrodes voltage quickly changes so that current flow continues on the other electrode of the second pair. By example, 10,000 volts would be placed across a pair of electrodes with these high resistor values. Additionally, the same high voltage would be put across a larger gap using electrodes that have much lower resistance. The small gap between the first pair would arc, bringing the potential of those ions and the electrode ends up to approximately 5,000 volts if the resistors are equal. By generating these ions near the larger gap, the gap resistance is reduced enough that the large gap ionizes. As the current begins to flow from the first gap to one of the electrodes of the second gap, both of the first electrodes float in voltage to near the voltage of the electrode of the second gap, preventing large currents from flowing to them and allowing a large current to form only between the two electrodes of the second gap.

A third embodiment (FIGS. 4 and 9) uses these high value resistor electrodes in parallel. Since the current is limited by the high value, each spark requires only a small fraction of the available power from the source of the high voltage. In this way the high voltage can be maintained even though one location will begin to flow current before the others. Without the high value resistors, as soon as one gap ionized, all the power would be dumped through that location without ever ionizing another location.

This invention takes advantage of high value resistors and the huge change in the effective resistance of the spark gap, to cause ionization in a much larger volume than would be the case in a normal spark plug. This allows for leaner mixtures to ignite reliably or conversely, for a given supply voltage, reliable ignition takes place at much higher operating pressures.

While specific voltages, electrodes numbers, electrode spacing and other characteristics are described here, it is to be understood that they are shown for example. Actual conditions will vary based on many conditions, not the least of which might be the available diameter of the spark plug for a given application. Additionally, as compression ratios increase either gap size or supply voltage will need to change accordingly. In this disclosure the terms ionize, spark and arc are used somewhat interchangeably. Current does flow prior to ionization but at very low values. Once the gas is ionized, it is difficult to maintain the discharge in a glow condition and it quickly moves to a spark or arc condition.

Referring first to FIG. 1, the spark plug for this embodiment includes an ordinary cylindrically shaped housing 10 threaded to cooperatively engage threads terminating on the interior of a cylinder. The housing 10 is preferably metal and provides a ground potential through the engine block or cylinder. A main electrode 12 extends from the housing 10 into the interior of the cylinder.

A second main electrode 11 is disposed through the center of the spark plug and receives a high voltage from an ignition system, as is commonly done. A plurality of secondary electrodes 13, 14, 15 and 16 are disposed between the main electrodes and each has a gap between one another and the main electrodes. For the embodiment of FIG. 1, each of the secondary electrodes is coupled through a resistor, such as resistor 17, to the main electrode 11.

The gaps defined by the secondary electrodes and main electrodes form a linear structure defining five gaps. Any number of secondary electrodes could be chosen based on available HV supply. As shown in FIG. 1, the gap between the secondary electrode 13 and the main electrode 12 is 0.045 inches for this embodiment. The gap between the secondary electrode 13 and the secondary electrode 14 is 0.044 inches; the gap between the secondary electrodes 14 and 15 is 0.043 inches; and the gap between the secondary electrodes 15 and 16 is 0.042 inches. The gap between the secondary electrode 16 and the main electrode 11 is shown as 0.041 inches.

Before any ignition, when a potential is applied between the main electrodes 10 and 11, the secondary electrodes 13–16 remain at the potential of the main electrode 11, since no current is flowing through the resistors. Initially, the high voltage applied to the electrode 11 appears between the gap defined by the secondary electrode 13 and the main electrode 12. Assume that the potential is large enough to obtain ionization across the 0.045 inch gap, then current begins to flow through the electrodes 12 and 13 and through the resistor 17 to the main electrode 11. As soon as this current begins to flow, the drop across resistor 17 causes the secondary electrode 13 to be close to the potential of the electrode 12, the difference between the potentials being the voltage drop across the 0.045 inch gap.

Once the potential on the secondary electrode 13 is close to the potential of the main electrode 11, the high voltage on the main electrode 11 is substantially across the gap defined between the secondary electrodes 13 and 14, i.e., the 0.044 inch gap. Again, a ionization current flows and the resistor coupled to the secondary electrode 14 prevents a large arc since it limits the current across the gap. As soon as current begins flowing through the secondary electrode 14, its potential drops to substantially the potential of the main electrode 12 plus the drop across the 0.045 and 0.044 inch gaps.

Gap-by-Gap the ionization current advances towards the main electrode 11 to finally, after current flows across the 0.041 inch gap, a high current arc will occur between the electrodes 11 and 12. As can been seen, the arcing occurs between the main electrodes 11 and 12, since there is no resistor in this path. The distance between these electrodes is the sum of the gaps shown in FIG. 1. Consequently, a substantial flame kernel results.

As also can be seen in FIG. 1, each of the gaps is slightly smaller beginning with the 0.045 inch gap and ending with the 0.041 inch gap. This arrangement provides a substantially equal voltage gradient across each of the gaps. Note the potential (when current flows) between the electrodes 12 and 13 will be less than the pre-current potential between the electrodes 11 and 16. The drops associated with the gaps between the electrodes 12 and 13, 13 and 14, 14 and 15, 15 and 16, and 16 and 11, will be substantially the same when current flows through all the gaps.

Importantly, each of the gaps shown in FIG. 1 are between approximately one-third to two-thirds the optimum gap discussed above.

The resistors, such as resistor 17, are preferably between 10 M ohms and 100 M ohms. In one embodiment, all the resistors are 20 M ohms and fabricated from silicon. The resistors typically are embedded within the spark plug. One physical arrangement for the resistors will be discussed in conjunction with FIG. 4.

In the alternate embodiment of FIG. 2, there is again a threaded cylindrical housing 20. Main electrodes 21 and 22 are configured the same as the corresponding main electrodes of FIG. 1. There are four secondary electrodes in FIG. 2, specifically electrodes 23, 24, 25 and 26. This time however, each of the secondary electrodes are connected to the housing 20 through a resistor such as the resistor 27 coupled between the electrode 23 and the housing 20. The gaps defined by the secondary electrodes are formed in a linear arrangement between the main electrodes. Unlike FIG. 1, the largest gap, 0.045 inches, is between the main electrode 21 and the secondary electrode 26. The smallest gap, 0.041 inches, is located between the main electrode 22 and the secondary electrode 23.

When a high potential is applied to the electrode 21, it will appear across the gap defined by the secondary electrode 26 and main electrode 21. This is because the electrode 26 is substantially at ground potential since its resistor is coupled to the housing 20. Therefore, with the embodiment of FIG. 2, the 0.045 inch gap first begins to conduct with a low current spark. Then, one by one the other gaps conduct with the final gap of 0.041 inches conducting. When this occurs, there is a high current arc between the main electrodes 20 and 21.

As in the case of the embodiment of FIG. 1, each of the gaps are approximately one-third to two-thirds the optimum gap distance. Conduction occurs beginning with the largest gap and ending with a smallest gap.

Figure 3:
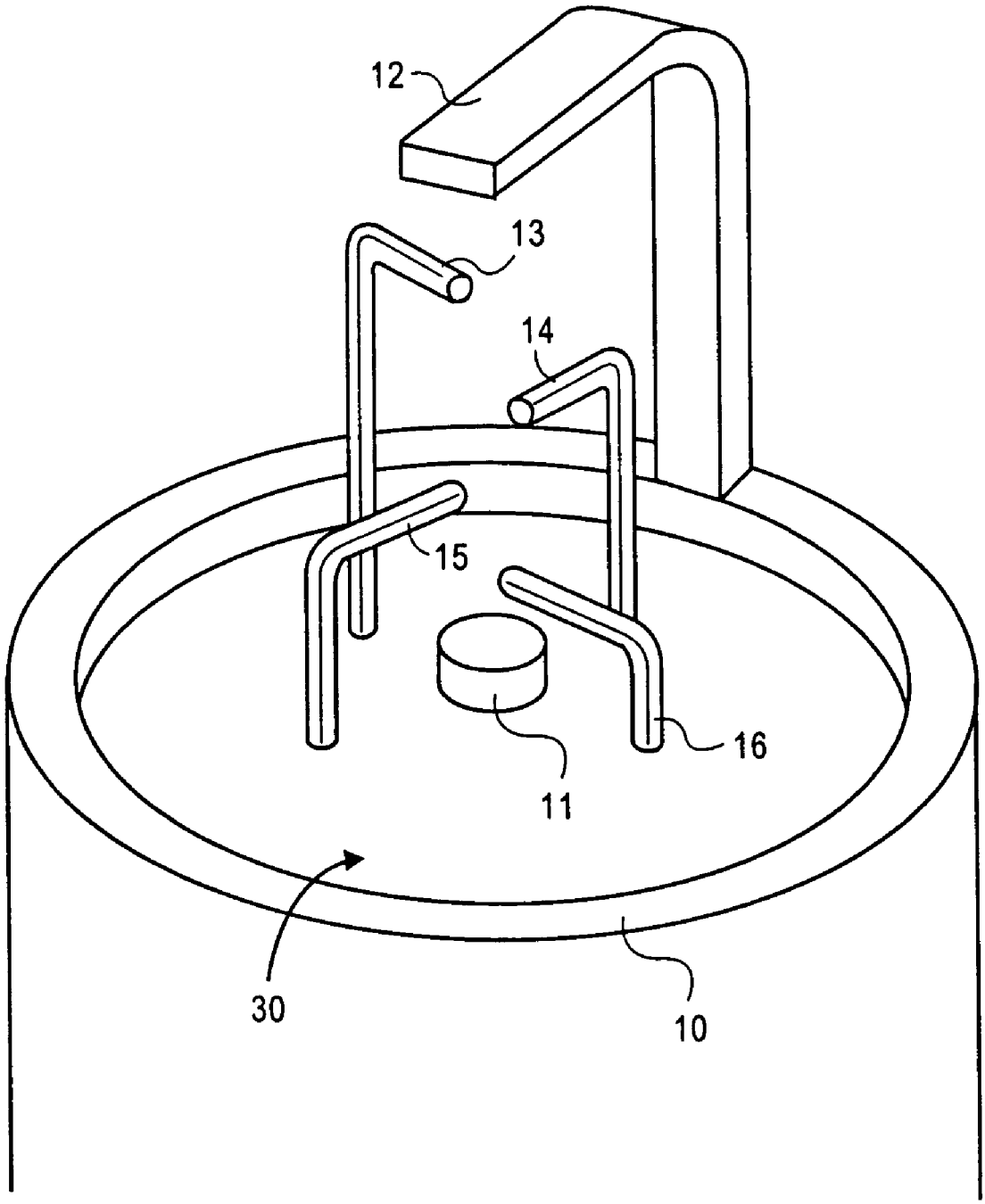
FIG. 3 is a perspective view of a spark plug for the embodiments of FIGS. 1 and 2.

FIG. 3 shows an arrangement of the main and secondary electrodes on a spark plug face 30 for the electrodes of FIG. 1. Each of the secondary electrodes emerges from the circular face 30, spaced apart from one another and from the electrode 11. The arrangement of FIG. 3 can also be used for the embodiment of FIG. 2.

Figure 4:
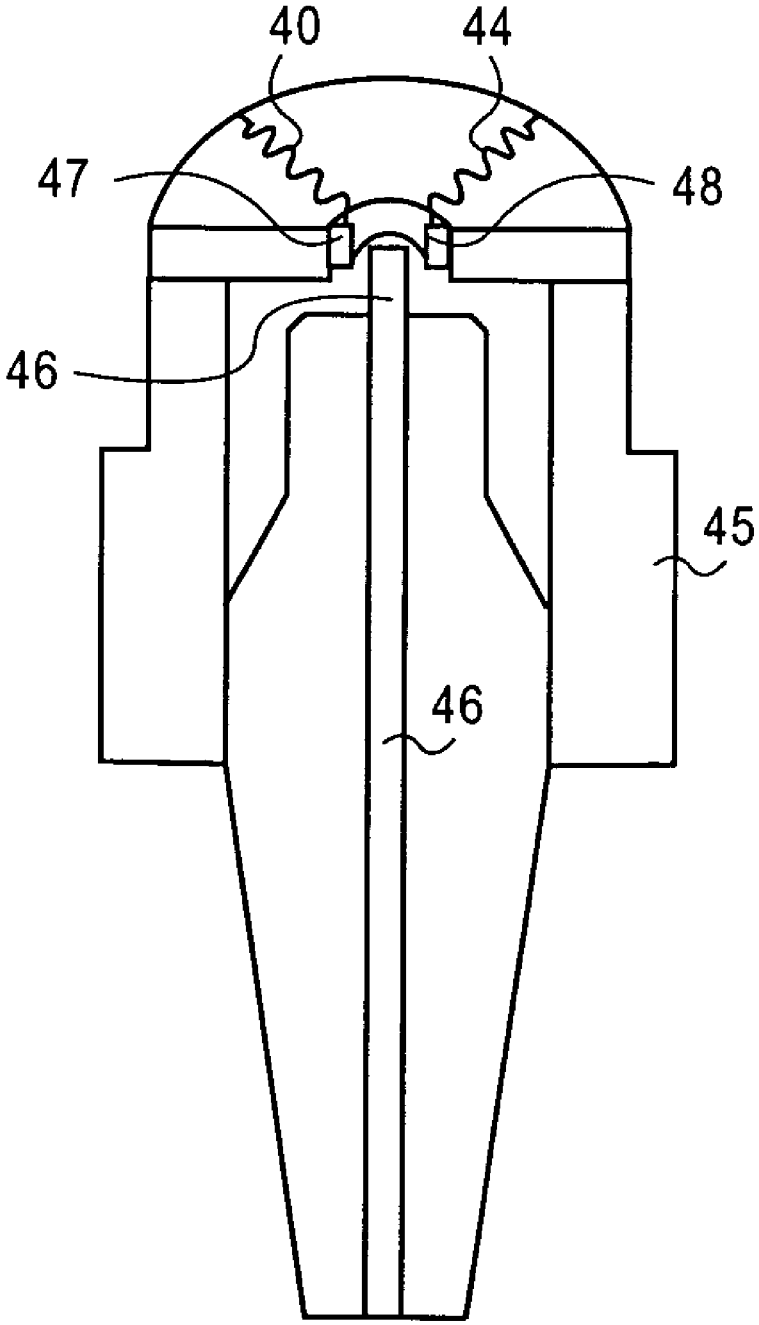
FIG. 4 is a cross-sectional cutaway view of a spark plug showing an arrangement of the resistors used in some embodiments of the present invention.

In the cross-sectional view of FIG. 4, the cylindrical housing 45 of a spark plug is shown. Two of five resistors 40 and 44 are shown coupled between secondary electrode of the spark plug and the outer housing 45. A central main electrode 46 is also shown. One end of each of the resistors is connected to one end of a secondary electrode, for instance, the end of resistor 40 is connected to electrode 47.

For instance, the resistor may be formed on an alumina disc from deposited silicon (thin film) patterned into multiple resistors. These resistors are then covered with a protective coating of alumina, silicon dioxide or silicon nitride.

Figure 5:
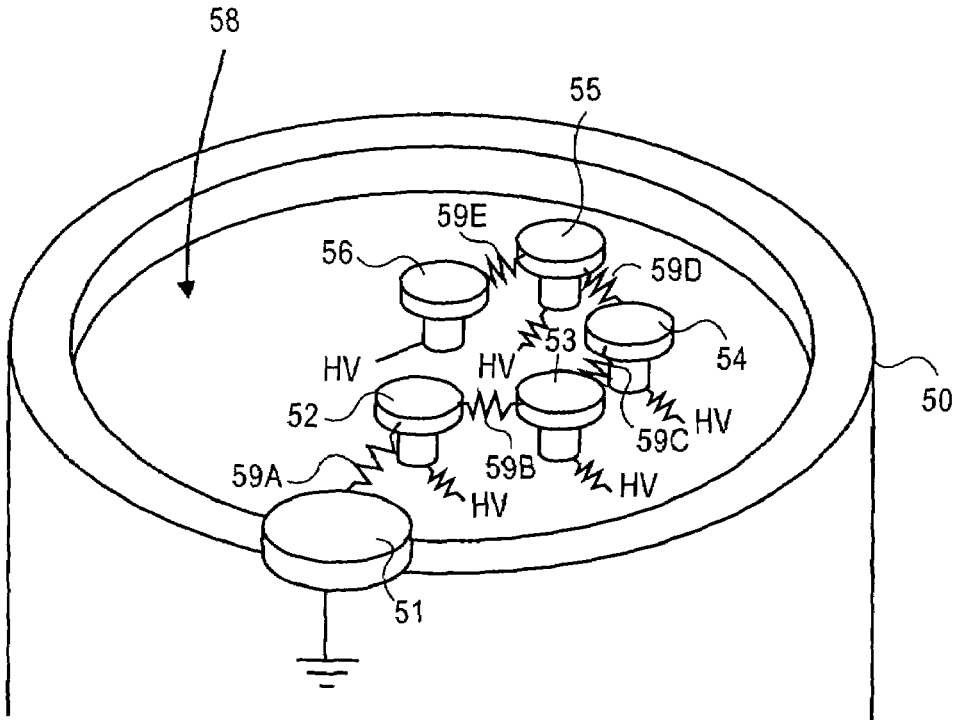
FIG. 5 is a partial perspective view of another embodiment of a spark plug showing a plurality of gaps.

Referring to FIG. 5, in this embodiment, there is a single main electrode 51 and a plurality of secondary electrodes 52–56 on the spark plug face 58. Cylindrical housing 50 includes threads not shown for engaging a threaded aperture which communicates with the interior of a cylinder. The main electrode 51 is coupled to ground, typically through the engine block or cylinder. All the secondary electrodes, except for electrode 56, are coupled to high voltage through a high value resistor. Electrode 56 is connected directly to the high voltage.

A first gap is defined between the main electrode 51 and the secondary electrode 52, a second gap between the secondary electrodes 52 and 53, a third gap between the secondary electrodes 53 and 54, a fourth gap between the secondary electrodes 54 and 55, and a fifth gap between the secondary electrodes 55 and 56. As with the other embodiments, each of these gaps is approximately one-third to two-thirds the optimum gap distance.

The distance of the gaps for the embodiment of FIG. 5 may be graduated as in the embodiment of FIG. 1. In this case, the largest gap is between the main electrode 51 and the secondary electrode 52, and the smallest gap between the secondary electrodes 55 and 56.

The spark plug of FIG. 5 operates in the same manner as the spark plug of FIG. 1. For instance, first the current flows between the electrodes 51 and 52 as shown by current 59A. Once current begins to flow, as was the case with the embodiment of FIG. 1, the secondary electrode 52 then drops to close to ground potential because of the voltage drop across the resistor coupling the secondary electrode 52 to the high voltage. Then in a cascading fashion, the current flows between the electrodes 52 and 53 as shown by current 59B followed by current 59C, 59D and 59E.

One advantage to the embodiment of FIG. 5 (and FIGS. 6 and 9) is that the electrodes are substantially out of the hot gas stream and consequently stay cooler. This helps prevent "dieseling" associated with too hot an electrode.

While it is preferred that each of the gaps in the embodiments of FIGS. 1, 2, 5 and 6 are all different to allow for voltage drop for each gap, this is not necessary. In fact, all the gaps may be the same.

Figure 6:
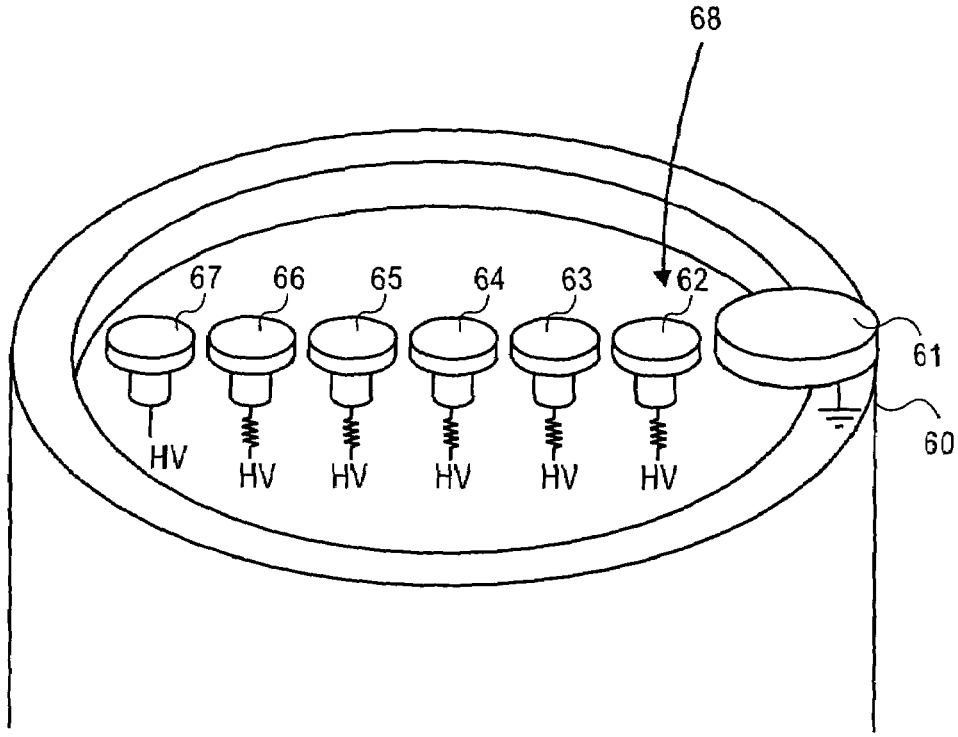
FIG. 6 is another arrangement of the spark plug of FIG. 5.

Referring now to the embodiment of FIG. 6, this embodiment is similar to the embodiment of FIG. 5. Again, there is the cylindrical portion 60 of a spark plug illustrated with a main electrode 61. There are a plurality of secondary electrodes 62, 63, 64, 65, 66 and 67. These electrodes are formed in a linear arrangement across the face 68 of the spark plug. All of the secondary electrodes 62–66 are coupled to the high voltage of the ignition system, each through a high voltage resistor except for electrode 67 which is coupled directly to the high voltage.

In operation, first a current occurs between the electrodes 61 and 62, and then continues across the gaps formed between the electrodes 62–63, 64–65, 65–66, and finally 66–67. Then a high current flows from electrode 67 through the secondary electrode and their gaps to the main electrode 61.

Figure 7:
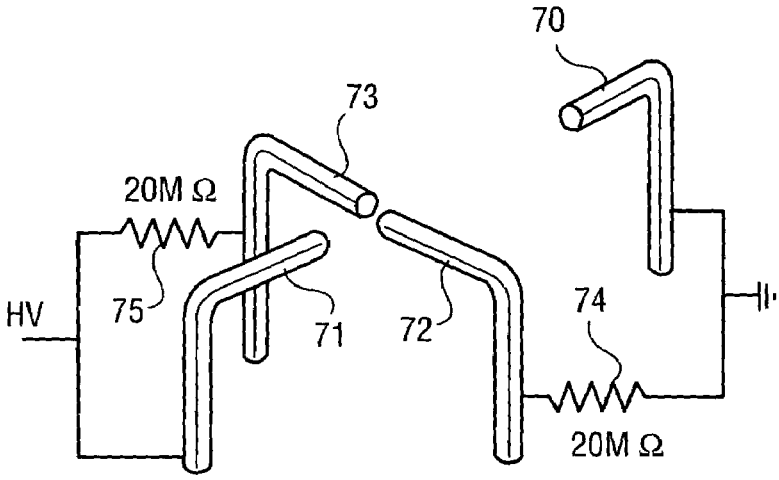
FIG. 7 is a perspective view of another embodiment of the present invention where the gaps are intersecting one another.

In FIG. 7 four electrodes 70, 71, 72 and 73 are illustrated, each of which extend from the face of a spark plug into a cylinder. A relatively large gap is defined between the electrodes 70 and 71. An additional smaller gap is defined between the electrodes 72 and 73. This gap is preferably one-third to two-thirds the optimum gap distance and at a right angle to the gap defined by the electrodes 70 and 71. The electrode 70 is coupled to ground and the electrode 72 is also coupled to ground however, through a resistor 74. The electrode 71 is coupled to the source of high voltage. The electrode 73 is also coupled to the source of high voltage through a resistor 75.

In operation, a low current spark first occurs between the smaller of the gaps defined between the electrodes 72 and 73. As soon as this current begins to flow, the electrodes 73 and 72 are at a potential midway between the high voltage and ground. The low current spark only needs to provide electrons and ions near the gap between 70 and 71 to significantly reduce the field required to cause break-down in the larger gap. Hence, a high current spark forms between 70 and 71.

Figure 8:
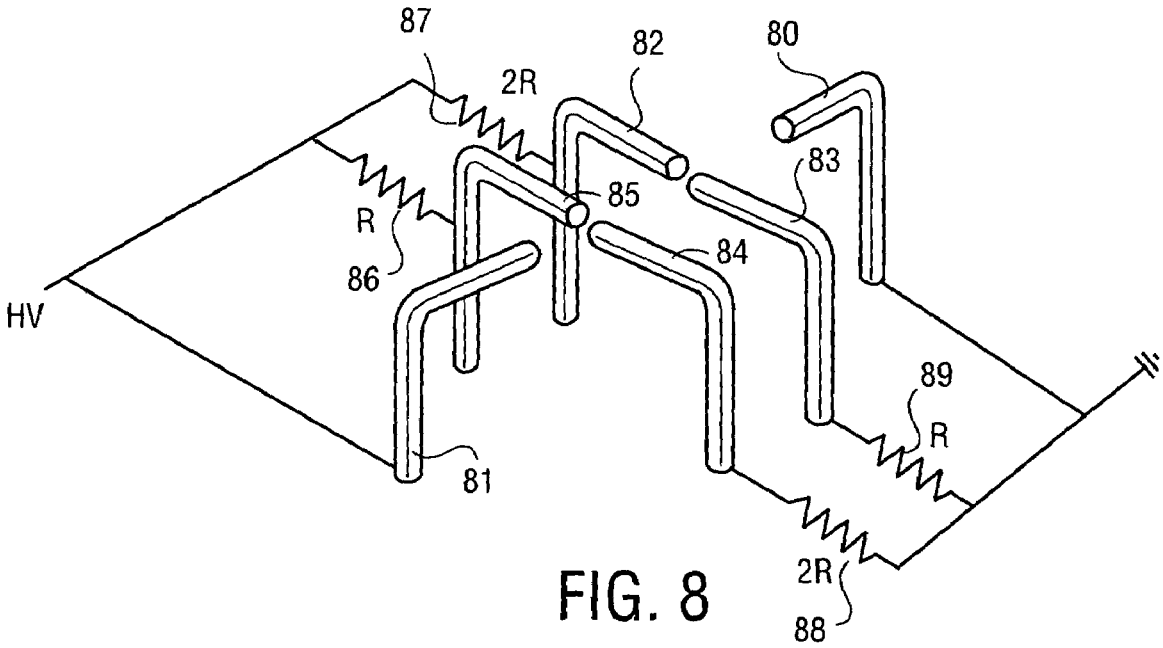
FIG. 8 shows an alternate arrangement of the embodiment of FIG. 7.

The embodiment of FIG. 8 is similar to the embodiment of FIG. 7 in that there are intersecting gaps. There is a first gap defined between the electrodes 80 and 81, this gap in operation eventually arcs. There are two other gaps at right angles to the first gap, one of these gaps is defined between the electrodes 84 and 85, and the other between the electrodes 82 and 83. These latter two gaps preferably have a gap distance which is one-third to two-thirds the optimum gap distance.

The electrode 85 is coupled to a high potential through a resistor 86. The electrode 82 is coupled to the same high voltage through a resistor 87. Resistor 87 has approximately twice the resistance of the resistor 86. The electrode 81 is coupled directly to the source of high voltage. Electrode 84 is coupled to ground through a resistor 88, and electrode 83 is coupled to ground through a resistor 89. The resistor 88 has approximately twice the resistance of the resistor 89. The electrode 80 is coupled directly to ground.

In operation, once a high potential is applied, a spark occurs between the electrodes 84 and 85, and between the electrodes 82 and 83. This occurs at about the same time where the gap distances are equal. Once this low current spark occurs, the electrodes 84 and 85 will be at near the same potential, this potential however, is closer to the high voltage than ground. In contrast, the potential of electrodes 82 and 83 will be substantially the same and will be closer to ground potential because of the voltage division that occurs between the resistors 87 and 89. Thus, there is a current flowing between electrodes 84 and 85 which electrodes are substantially at the same potential and closer to the high voltage. Also there is a current flowing between the electrodes 82 and 83 which electrodes are substantially at the same potential and closer to ground. This assists in causing an arc to occur between the electrodes 80 and 81.

Figure 9:
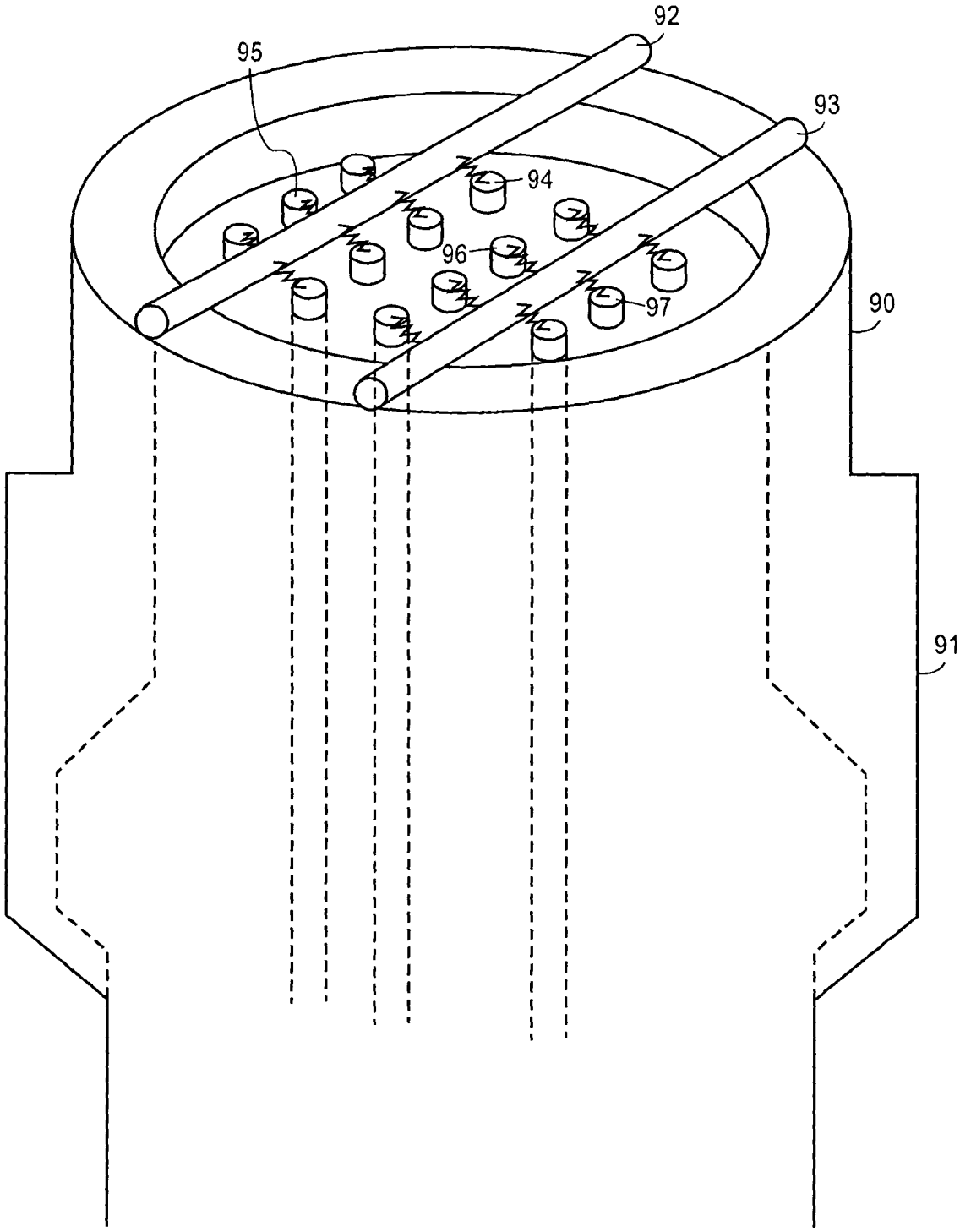
FIG. 9 is a partial perspective view of a spark plug showing an alternate arrangement of the main electrodes and secondary electrodes.

Referring now to FIG. 9, a cylindrical housing of a spark plug 90 is shown with a threaded section 91. The face of the spark plug includes two main electrodes 92 and 93 which are maintained at ground potential since they are secured to the housing 90. There are a plurality of secondary electrodes such as electrodes 96 and 97, disposed on both sides of the electrode 93. Similarly, there are a plurality of secondary electrodes such as electrodes 94 and 95 disposed on opposite sides of the electrode 92.

Each of the secondary electrodes is coupled to a source of high potential through a resistor.

In operation, once a source of high potential is applied, a low current spark will form from each of the secondary electrodes to its respective main electrode. In each case, the resistor limits the arc current such that the high voltage supply does not droop significantly. This insures that the other electrodes see substantially the same voltage allowing them to form arcs also.

Even though all of the secondary electrodes are nominally at the same distance from their respective main electrode, breakdown typically will not occur at the same voltage from all of the secondary electrodes. The slightest of imperfections in the shape of the secondary electrode, such as a sharp edge, or a slight variation in the distance, will cause the secondary electrodes to conduct at different voltages. All, however, will conduct at close to the same time.

Without resistors, once one arc is formed, all the current will flow through that low resistance path reducing the voltage on the remaining electrodes below that needed to form a spark.

Thus, several embodiments of a spark plug have been described where a plurality of electrodes are used. At least some of these electrodes are in the range of one-third to two-thirds the optimum gap distance and provide controlled current arcs.

What is claimed is:

1. A spark plug having a plurality of electrodes each connected in series with a resistor, the resistors having low enough resistance such that pre-ionization current flows through its respective electrode without significantly changing a voltage applied to the electrode and resistor, the resistance being high enough that the voltage change on the electrode is substantial once a gap defined by the electrode is ionized wherein the plurality of electrodes are arranged to form a series of gaps, the size of each gap being adjusted to facilitate ionization current flow to occur one after the other between the series of gaps, the gaps being one-third to two-thirds an optimum gap distance for a single gap.

2. A spark plug comprising:

a first and a second main electrode, spaced-apart by a distance N, each electrode for receiving a different potential; and a plurality of secondary electrodes, disposed between the main electrodes, each having a gap between one another and the main electrodes, each gap being different from one another, the sum of the gaps being equal to the distance N, each gap having a gap distance between one-third to two-thirds the optimum gap distance for a single gap.

3. The spark plug defined by claim 2, wherein one of the main electrodes is disposed through the center of the spark plug, and wherein the resistors are connected between the center of the spark plug and each of the secondary electrodes.

4. The spark plug defined by claim 2, wherein one of the main electrodes comprises an outer threaded cylindrical housing, and wherein the resistors are connected between each of the secondary electrodes and the outer member.

5. A spark plug comprising:

a main electrode;

a plurality of secondary electrodes, each having a gap from one another, with a first of the secondary electrodes having a first gap with the main electrode where all the gaps are between one-third to two-thirds an optimum gap distance for a single gap; and a plurality of resistors each coupled between a common node and one of the secondary electrodes.

6. The spark plug defined by claim 5, wherein the main electrode is part of an outer cylindrical housing.

7. The spark plug defined by claim 6, wherein the secondary electrodes are mounted on a generally coplanar surface.

8. The spark plug defined by claim 7, wherein the secondary electrodes are linearly aligned.

9. The spark plug defined by claim 5, wherein the main electrode is coupled to a ground potential, and the common node is coupled to a high potential.

10. The spark plug defined by claim 9, wherein each of the gaps is different from one another.

11. The spark plug defined by claim 10, wherein the secondary electrodes are arranged in a linear configuration.

* * * * *